US006490853B1

(12) United States Patent
Winklhofer et al.

(10) Patent No.: US 6,490,853 B1
(45) Date of Patent: Dec. 10, 2002

(54) METHOD FOR JOINING A FLAT-LINK ARTICULATED CHAIN ELEMENT

(75) Inventors: Gerhard Winklhofer, Krailling (DE); Dag Heinrich, Penzberg (DE); Thomas Fink, Dachau (DE)

(73) Assignee: Joh. Winklhofer & Söhne GmbH & Co. KG., München (DE)

( * ) Notice: Subject to any disclaimer, the term of this patent is extended or adjusted under 35 U.S.C. 154(b) by 0 days.

(21) Appl. No.: 09/744,949

(22) PCT Filed: Aug. 6, 1999

(86) PCT No.: PCT/EP99/05709

§ 371 (c)(1),
(2), (4) Date: Apr. 12, 2001

(87) PCT Pub. No.: WO00/09277

PCT Pub. Date: Feb. 24, 2000

(30) Foreign Application Priority Data

Aug. 11, 1998 (DE) ..... 198 36 374

(51) Int. Cl.[7] ..... B21L 9/06; B21L 21/00
(52) U.S. Cl. ..... 59/7; 59/11; 59/35.1
(58) Field of Search ..... 59/8, 7, 35.1, 78, 59/84

(56) References Cited

U.S. PATENT DOCUMENTS 3,075,346 A * 1/1963 Quarve et al. ..... 59/7
3,099,130 A * 7/1963 Pahl ..... 59/7
3,969,889 A 7/1976 Araya ..... 59/8
4,027,471 A 6/1977 Lipp et al. ..... 59/7
4,531,355 A * 7/1985 Numakura ..... 59/11
4,621,491 A * 11/1986 Moriki et al. ..... 59/7
5,214,908 A * 6/1993 Livesay et al. ..... 59/7

FOREIGN PATENT DOCUMENTS

| | | |
|---|---|---|
| DE | 107106 | 12/1899 |
| DE | 3629613 | 3/1988 |
| EP | 0 387 884 | 9/1990 |
| GB | 2 103 983 | 3/1983 |

* cited by examiner

*Primary Examiner*—David B. Jones
(74) *Attorney, Agent, or Firm*—Finnegan, Henderson, Farabow, Garrett & Dunner, L.L.P.

(57) ABSTRACT

A method for joining a plate chain link is to be improved, in which at least one plate is connected to at least one bolt by way of a pressing and aligning process. This is achieved by the measures that the bolt is centered in relation to a main chain axis by the simultaneous active application of symmetrical clamping forces to the faces and the least one plate is pushed by a joining lift relative to the bolt into a position symmetrical to the main chain axis. Furthermore, the invention relates to a device for carrying out the method.

33 Claims, 4 Drawing Sheets

METHOD FOR JOINING A FLAT-LINK ARTICULATED CHAIN ELEMENT

The present invention relates to a method for joining a plate chain link, wherein at least one plate is connected to at least one bolt by a pressing and aligning process. Furthermore, the present invention relates to a method for carrying out the method.

In the prior art very different methods for joining a plate chain link or a plate chain have established themselves. These methods are in part quite different and are adapted to the designs of the various plate chains. There are methods in which only the inner chain links are produced and a further method is subsequently performed for joining the chain by producing the outer chain links, with the already prefabricated inner chain links being interposed. This means that the methods must be suited, on the one hand, for joining solid bolts with plates and, on the other hand, for joining hollow bolts (sleeves) with plates. In the manufacture of an outer chain link for a duplex chain a plate must e.g. first be slid in central fashion onto a solid bolt. The interposition of rollers for making a roller chain should also be possible with the individual methods.

In particular in high-quality control chains, dimensional accuracy with respect to the parallelism of the bolts (solid bolts and sleeves) and plates, the distance of the plates when several plates are used, as well as the centering of the chain link elements relative to the main chain axis, are of decisive importance.

Normally, the chain links are built up from below. This means that the lower plate is first positioned and the associated bolt is supplied. In the manufacture of an inner chain link the plate and the sleeve are then centered relative to each other via a positioning mandrel projecting from the assembly plane. Subsequently the lower plate and the sleeve are pressed together. Optionally, before or after said process a roller may additionally be mounted on the sleeve. Finally, the upper plate is supplied and also centered relative to the sleeve by means of a positioning mandrel and subsequently pressed thereonto. This procedure is carried out at predetermined cycles so that a joint press block operating with a specific lift number respectively applies the pressing force. This can be carried out on a circular table or successively in series.

DE 2 457 241 A1 already discloses a method for producing chain links on successively arranged rotary mounting tables, the method employing the layered construction of the chain link from the bottom to the top, but already effecting an excellent alignment of the individual chain link elements relative to one another thanks to the skillful use of positioning mandrels. This method, however, employs many joining steps which must be simplified. Moreover, a centering relative to a main chain axis is not fully achieved. What poses, in particular, problems are the different lengths of the bolts, so that the centering operation relative to the main chain axis is not satisfactory. It is now desirable to provide a method which with a few steps can achieve an adequate centering or symmetry of the chain links to be produced relative to the main chain axis, i.e., independently of the type of chain link (by centering a single plate in the center of the bolt or by symmetrical arrangement of two plates on the end portions of a bolt).

It is therefore the object of the present invention to provide a method and a device for joining a plate chain link which exhibits improved dimensional accuracy, in particular, with respect to symmetry in relation to the main chain axis.

According to the invention this object is achieved by providing a method for joining a plate chain link of the above-mentioned type, in which the at least one bolt is centered relative to a main chain axis by the simultaneous active application of symmetrical clamping forces to the faces of the bolt, and the at least one plate is pushed by a joining lift relative to the bolt into a position symmetrical to the main chain axis on the bolt.

The method of the invention mainly differs from the methods in the prior art by the features that while the bolts are being centered there is no action against a fixed stop, but rather a central centering operation is carried out by the simultaneous application of symmetrical clamping forces. Of particular importance is here the term "active application" because in the prior art the force is actively applied only from one side, whereas the other side in this process is at a standstill and acts as a stop (passive application of force). The difference is now that in the prior art the dimensional accuracy, in particular, of the symmetry relative to the main chain axis is determined by the face of the chain bolt that rests-on the stop. In the present invention, the center of the main chain axis is always found in an exact way because the bolt is automatically aligned with said axis due to the active application of symmetrical clamping forces. The principle is similar to a pair of tongs in the case of which the press forces are also applied in symmetry with a line of symmetry extending through the pivot axis of the tongs. The advantage is that the chain bolts need not necessarily be produced with a very small range of tolerance, because the faces of a bolt always have the same distance from the main chain axis. This makes it also possible to simultaneously center the two bolts of a chain link in one operation if these are respectively acted upon with symmetrical clamping forces. It might be that a distinction has to be made in this method between joining lift and centering by the symmetrical clamping forces because an excellent dimensional accuracy (symmetry) is also achieved when the symmetrical clamping forces become only operative at the end of the joining operation and thereby ensure the final joining position of the bolts.

In most cases it is of advantage when the joining lift is carried out by pushing the at least one plate onto the at least one bolt and by moving the at least one plate by the simultaneous active application of symmetrical joining forces into a position in symmetry with the main chain axis. In this instance, too, the force may only be applied during the joining lift at one side of a plate as long as it is ensured that a symmetrical force couple is applied at the end of the joining lift to arrange the plates in symmetry or to center the one plate in the center. By analogy with the bolts, the plates are then also very exactly aligned relative to the main chain axis.

Furthermore, it is also possible for specific chain links that the joining lift is carried out by pushing the at least one bolt into the at least one plate and that at least at the end of the joining lift the at least one bolt is centered relative to the main chain axis by the simultaneous active application of the symmetrical clamping forces. This means in such a case that the plates are not pushed onto precentered bolts, but the at least one bolt is pushed into an opening of the plate and the bolt is subsequently centered. In such a process the plate can be fixedly anchored in its position. Such a procedure is mainly applied in the case of intermediate pin plates for duplex chains because in duplex chains the push-on paths of the bolt relative to the plate are bound to be long.

When two plates are simultaneously pushed onto the respectively opposite end portions of the bolt, this may be carried out via a corresponding centering stop on the force-applying elements, so that these occupy their symmetrical position relative to the main chain axis. Each of the outer surfaces of the plates will then have exactly the same distance from the main chain axis. Since the thickness of the plates can be produced at the same costs with a much smaller tolerance than the length of the bolts, the distance of the insides of the plates is also within the necessary range of tolerance.

Advantageously, a further method step may be provided in which the at least one plate and the bolt are prepositioned relative to one another so that an opening in the plate is arranged to be coaxial to the bolt. What should here also be called novel is the fact that independently of the number of the bolts and the plates the whole chain link can be prepositioned and can be joined in a joint centering and pressing operation. This, however, means that, in contrast to the prior art in which many lifting operations were needed for joining a single chain link, these can be carried out in a single joining station thanks to the method of the invention. On the one hand the pressing operation proper can be performed at a lower speed so that advantageous pressing conditions with less heat development are prevailing. On the other hand, the number of the manufactured parts can nevertheless be at least maintained if not even increased per time unit.

Furthermore, it may be provided that simultaneously with the application of the symmetrical clamping forces the at least one plate is guided to be coaxial to the bolt and is already pressed in part onto the bolt. As a result, the plates are centrally attached to the bolt so that no additional attaching forces have to be applied by the joining lift proper.

To apply the symmetrical clamping forces in a way that they are as coaxial to the bolt axis as possible, these can be produced by two positioning mandrels that are movable towards each other in a uniform and constant way. While the centering operation is carried out by the positioning mandrels themselves when hollow bolts are used in the case of an inner chain link, it is possible in the centering operation of a solid bolt to hold said bolt in portions in a prism for aligning the same in coaxial fashion. Such positioning mandrels can also be guided very easily and can accurately be attached to the bolt.

To enable the joining lift to apply a pressing power which is distributed as uniformly as possible around the bolt axis, the joining lift may be carried out by an upper and/or lower press block arranged around the positioning mandrels, with the press blocks applying the symmetrical joining forces. Since the positioning mandrels normally have a diameter substantially corresponding to (most of the time slightly smaller than) the outer diameter of the. bolt, the press block additionally provides a guide when the plates are pressed on. This is of enormous advantage in particular when a single plate is pressed into the center of a long bolt in a duplex-type outer chain link because the long bolt cannot deflect. It is again important that the joining lift can only be carried out by one press block when a single plate is pushed on and that the plate is aligned at the end of the joining lift by a counterpressure of the second press block.

Optionally, it may be desired that the joining lift is carried out by a positioning mandrel and that the symmetrical clamping forces for a bolt are applied by positioning mandrels that can be moved towards each other in a uniform and constant manner. This means that a bolt (sleeve) is pressed into a plate by means of the positioning mandrel and that a centering operation is only carried out at towards the end of the joining lift by the action of the second positioning mandrel from the opposite side.

Furthermore, the present invention relates to a device for joining a plate chain link. The device comprises an axially movable upper positioning mandrel and an axially movable lower positioning mandrel between which a bolt of the chain link can be positioned and clamped, a lifting mechanism by which the positioning mandrels are displaceable at a right angle relative to a main chain axis and by which active symmetrical clamping forces in relation to the main chain axis can be applied to the faces of the bolt, so that the bolt can be centered relative to the main chain axis, as well as an upper press block and a lower press block by which the at least one plate can be brought into a position in symmetry with the main chain axis or can be clamped therein.

The device is constructed such that it centers the at least one bolt of the chain link in one joining operation and pushes the at least one plate onto the bolt. The bolt can also be pushed into the plate. Furthermore, it is novel that a positioning mandrel is used for applying a clamping force. Positioning mandrels that have been used so far have mainly been used for coaxial alignment and not for the application of axial forces. In this respect it would be possible to produce a joining head according to such a principle, with the head producing a chain link by means of a single joining operation, or finishing a chain by assembling an outer chain link with interposition of an inner chain link. The alignment relative to the main chain axis forms part of the joining operation. The lifting mechanism must have a symmetrical forced coupling of the positioning mandrels. This forced coupling may also be carried out hydraulically, or pneumatically, but preferably mechanically. A principle based on some kind of tongs is here possible as a simple means of solution.

According to an advantageous development a lifting mechanism may be provided for displacing the upper and lower press blocks, by which lifting mechanism said press blocks can be displaced in symmetry with and at a right angle to a main chain axis and by which, at the same time, active symmetrical joining forces in relation to the main chain axis can be applied for performing the joining lift, so that the at least one plate can symmetrically be pushed onto the bolt. Depending on the construction of the chain link, this may be the same lifting mechanism as used for the positioning mandrels. In most cases, however, a separate lifting mechanism which is arranged in parallel therewith is used because the press blocks have to be actuated in a different way than the positioning mandrels. At any rate, this preferred and also force-coupled lifting mechanism provides for an adequate symmetry of the plates on the bolt.

In particular for the production of an intermediate pin plate for a duplex chain, the press block in a simplified version of the device may be designed as a movable and a stationary clamping jaw by which the at least one plate can be fixedly clamped in a position substantially in symmetry with the main chain axis, and the joining lift can be carried out by the at least one positioning mandrel. The press blocks are adjusted such that the plate can be clamped substantially in symmetry with the main chain axis between said blocks. In such a case the plate does then not perform a further aligning movement during the joining operation. The bolt is slid into the plate at one side and at the end of the joining lift it is centered by the symmetrical application of the clamping forces in symmetry with the main chain axis.

Advantageously, the lifting mechanism for the two positioning mandrels may comprise a joint drive with forced guidance, by which the two positioning mandrels are movable in coaxial and symmetrical fashion relative to each other. The lifting mechanism is thereby strongly simplified because a single drive moves both positioning mandrels. A forced guidance will then provide for the symmetrical conversion of the displacement path predetermined by the drive and of the displacement speed.

The lifting mechanism for the upper and lower press blocks may also comprise a joint drive with forced guidance by which the two press blocks are movable in coaxial and symmetrical fashion relative to one another. The same advantages as for the joint drive of the positioning mandrels are here observed.

When according to one embodiment the drive comprises a slide bushing which is controlled in its linear movement by a cam and which moves the positioning mandrels or the press block via a symmetrical lever linkage, it is additionally possible to combine the drive for the press blocks and the drive for the positioning mandrels because the two cams can be jointly drivable. The guidance by means of cam and controlled slide bushing is very robust and can apply the necessary forces required for pressing the chain links. Moreover, the forced guidance operates very accurately and is exactly adjustable. The centering and joining forces can be produced in symmetry by means of a few components. The lever linkage can be changed very easily, so that apart from a control by the cam there is also a possibility of adjustment via the lever linkage or the complete exchange thereof.

Moreover, at least one lever section of the lever linkage may be designed to be adjustable in its length. It is thereby very easily possible to adjust the displacement path of a positioning mandrel or of a press block. Suitable adjusting devices permit a very high precision of the adjusting operation.

The whole lift mechanism is very simplified in its structure by the measure that an overload protection means of a compressible length is provided between slide bushing and cam and/or in the lever linkage. This overload protection means also compensates for the different lengths of the bolts or the thicknesses of the plates. This means that as soon as the necessary clamping force has been applied and e.g. a further force of displacement has been exerted by the cam on the slide-bushing, said bushing cannot move further and the length of path which is additionally produced by the cam is compensated by the overload protection means. Such a possibility of compensation may also be provided at any other desired and suitable place of the lifting mechanism. For instance, the positioning mandrels and press blocks themselves may comprise suitable compression means which are compressed as soon as a specific force has been reached. This is most advantageous in the case of the positioning mandrels because the centering force would increase very strongly as soon as both positioning mandrels had been brought into contact with the faces of the bolt.

To minimize the risk of deflection of the force-applying positioning mandrels, these may be guided in coaxial bores of the press block and may be movable relative to said block. This intimate arrangement of press block and positioning mandrel also ensures an exact alignment and positioning.

To join, in particular, an inner chain link, the positioning mandrels may be provided—in particular according to one embodiment—with a cylindrical attachment which can be moved in accurately fitting fashion into the bore of a hollow bolt of an inner chain link and which defines an annular abutment step relative to the adjoining portion of the positioning mandrel which can be brought into contact with a face of the hollow bolt. The attachment thus moves into the hollow bolt and ensures a coaxial alignment in said bolt, and the abutment steps of the opposite positioning mandrels will then ensure a symmetrical centering operation relative to the main chain axis. A deformation of the face portion by the annular abutment step is not possible because of the cylindrical attachment.

Furthermore, the positioning mandrel may comprise a centering portion which can removed into the opening of the plate and aligns said plate such that it is coaxial to the hollow bolt. Thus the plate is also aligned by the positioning mandrel in an exact manner before said plate is pushed onto the bolt. This, however, means that the supply means must just ensure a prepositioning operation within a wide range of tolerance and the centering operation proper is carried out by the positioning mandrel. The feeding operation is also facilitated by this measure to a considerable degree.

To compensate for diameter tolerances of the opening in the plate, one variant provides that the centering portion has a frustoconical shape. A centering operation is thereby carried out at any rate, i.e. independently of the size of the opening within the tolerance zone.

In addition it has been found that the whole joining operation can be made more precise and improved in that the centering portion and the abutment step are designed such that a slight joining lift can be carried out by the positioning mandrel for the attachment of the plate to the outer surface of the hollow bolt before the abutment step rests on the face of the hollow bolt. The position of the abutment step and the length of the centering portion as well as the shape thereof are adapted to the opening, in particular the thickness of the plate, such that a corresponding attaching operation is carried out. For instance, the plate can already be pushed with one quarter onto the bolt by said operation. Of course, it is also possible to move the positioning mandrel in parallel with the press block in said portion so that the actual application of the force is mainly carried out by the press block and the positioning mandrel just assumes the centering task during the attaching operation.

For a pressing operation over a surface of the plate that is as large as possible, the press blocks in one embodiment comprise a press block surface which surrounds the associated positioning mandrel and is substantially arranged in planar and vertical fashion relative to the mandrel axis and is displaceable relative to the positioning mandrel and presses the plate onto the outer surface of the hollow bolt. Tilting forces on the plate are avoided because the plate rests on the press block surface over a large surface thereof.

Furthermore, the upper and/or lower press blocks may comprise an extension which during the joining lift stops its movement and defines an exact joining distance of the press block surfaces relative to each other at the end of the joining lift. This makes above all sense when two plates are to be pushed onto the end portions of a bolt. The extension then defines the distance of the two plates relative to one another so that the plates, although they are pushed on in symmetrical fashion, leave an exactly defined distance thereinbetween. As for extensions which are arrested and stop their movement, an overload protection means may be of advantage.

For most of the chain links it is desirable to produce the same in a single joining operation. This fact is best taken into account according to one embodiment in that two upper positioning mandrels and two lower positioning mandrels are respectively arranged for forming a joining head in a jointly associated upper and lower press block. Such a joining head compensates for variations in the lengths of the two bolts. A compensation in the plates is not needed because it must be assumed that one plate does not vary in its thickness. This results in a very simple and compact construction which fully meets the demands made on the joining operation.

Advantageously, a supply means is provided which prepositions all elements of a chain link and supplies the same in a prealigned manner to a joining head. This is also novel because so far individual parts have most of the time been supplied separately and have then been connected at a corresponding joining place to the already prealigned components. The prepositioning and feeding operations for all elements at one time, i.e. all components are interconnected by a single joining operation, have so far not been carried out in the prior art with such a quality.

The device according to the invention is able to finish the chain link in a single joining operation. So far chain links have always been of a layered structure, with a joining lift being again performed in each layer. It has in particular been the objective of this invention to provide a method and a device in which a press fit can be accomplished in one single operation, even in the case of intermediate pin plates for duplex chains. A subsequent alignment or further displacement of the plates and bolts relative to one another, which would always entail a weakening of the press fit, is avoided. The device can operate at relatively low joining speeds because relatively small lifts have to be produced in the joining head, and nevertheless a higher output of chain links can be achieved because the joining steps have been reduced to a single joining operation. Moreover, this is a forced assembly in which all components are force-guided during the joining operation. The components can thus be aligned with one another in a very precise way.

Embodiments of the present invention will now be explained in more detail with reference to a drawing, in which FIG. 1 shows a schematic joining sequence of an inner chain link in three steps;

Figure 1:
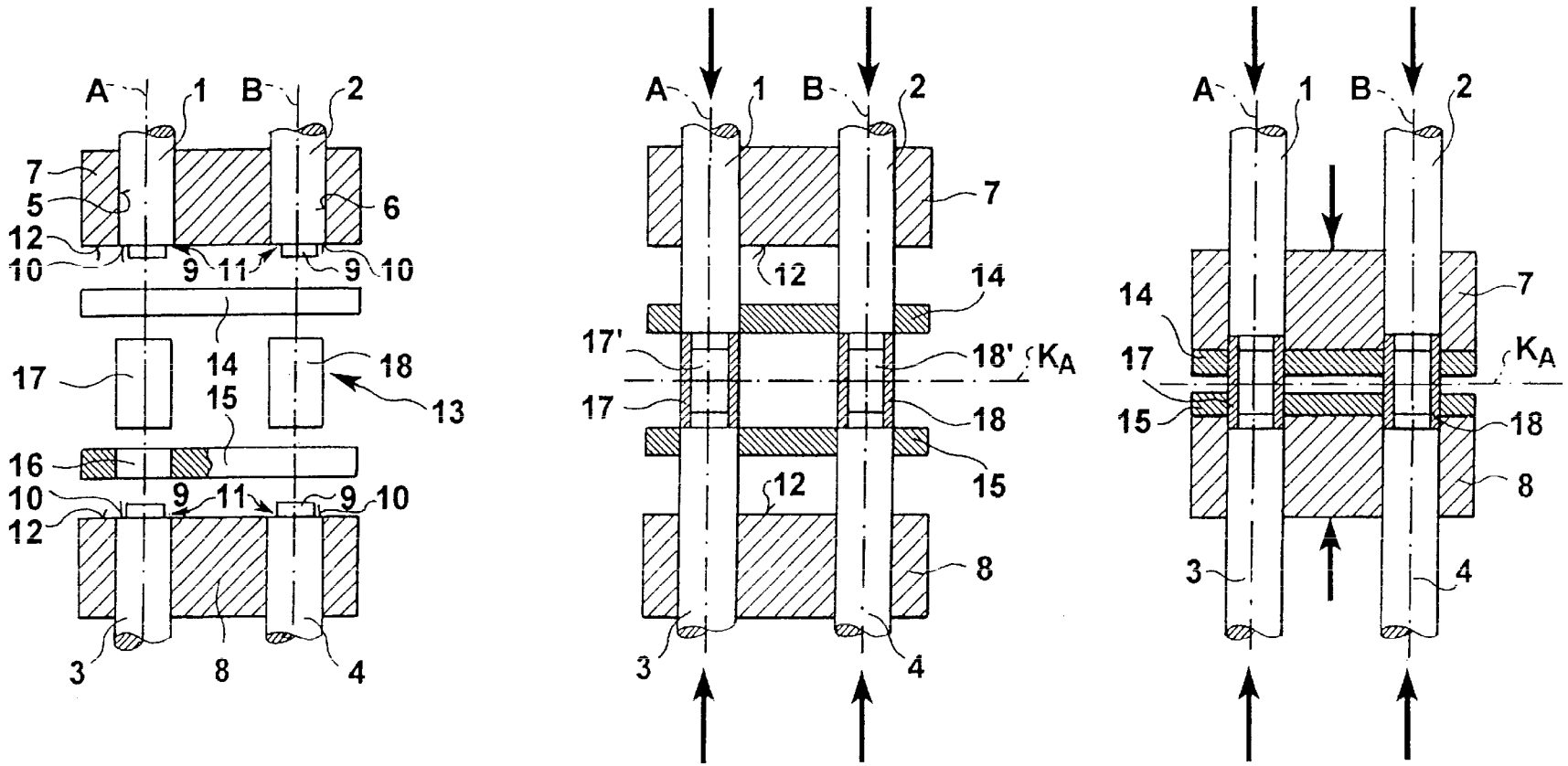
FIG. 1 shows the positions of the essential components of a joining head in each of the three steps of the method.

The joining head comprises two upper cylindrical positioning mandrels 1 and 2 that are each arranged to be axially displaceable along axis A and B, respectively. Coaxial to the positioning mandrels 1 and 2 are provided correspondingly associated lower positioning mandrels 3 and 4 which are also cylindrical and are displaceably arranged along axis A and B, respectively. Each of the positioning mandrels 1 and 2 is arranged in a corresponding cylinder bore 5 and 6 in a joint upper press block 7 and in a joint lower press block 8, respectively. Each of the press blocks 7 and 8 is arranged to be displaceable relative to the associated positioning mandrels 1 and 2 or 3 and 4 in parallel with axes A and B.

Each of the positioning mandrels comprises a coaxial cylindrical attachment 9 which projects to a certain extent beyond an abutment surface 10 of a surrounding abutment step 11.

Press blocks 7 and 8 comprise a press block surface 12 which extends in parallel with the abutment surface 10 and is arranged in a direction perpendicular to axes A and B and the positioning mandrels 1 and 2 and 3 and 4, respectively.

Figure 4:
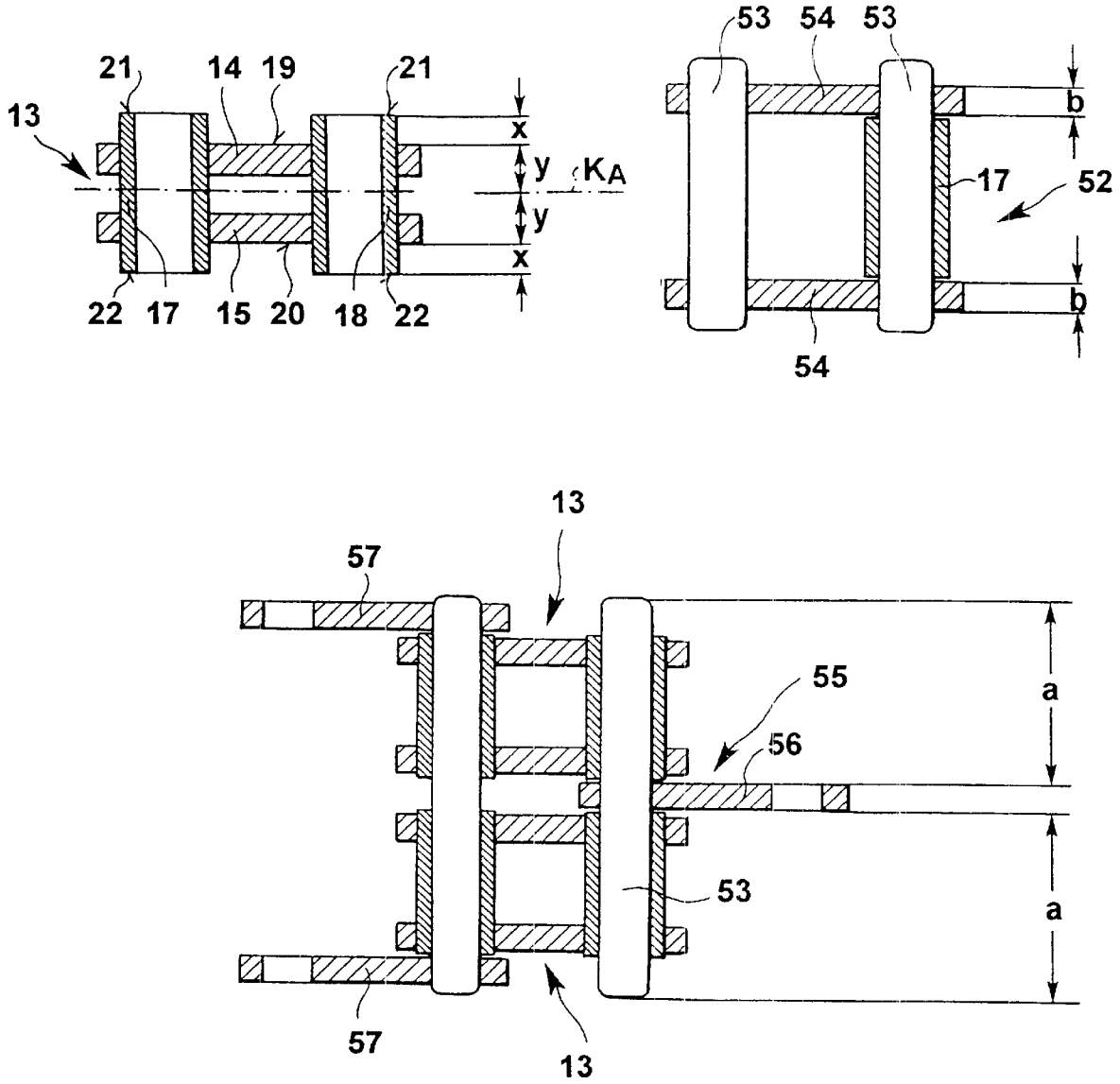
FIG. 4 shows, in full section, three possible variants of symmetrical plate chains to be joined.

In the instant example the whole joining head serves to join an inner link chain 13 consisting of two parallel plates 14 and 15 with cylindrical openings 16 and of two cylindrical hollow bolts 17 and 18 that are arranged in parallel with one another. An inner chain link 13 consisting of said elements is also shown in FIG. 4 at the left side, top. As is illustrated in FIG. 4 in an exaggerated manner, the end portions of the hollow bolts project beyond the outsides 19 and 20 of the plates 14, 15. The projection of the hollow bolts 17, 18, i.e. the distance of faces 21 and 22, respectively, from the associated outsides 19 and 20 of the plates 14 or 15, is marked by dimension X. Dimension X should have the same size at both sides, resulting in a symmetrical configuration. At the same time, outsides 19 and 20 of the plates 14 and 15 should have the same distance Y from the main chain axis $K_A$. As a result, faces 21 and 22 should also have the same distance from the main chain axis $K_A$.

While dimension Y is the same at both sides of the inner chain link 13, dimension X may be different when the hollow bolts 17 and 18 have different longitudinal dimensions. However, the symmetrical configuration relative to the main chain axis $K_A$ should always be maintained.

The basic mode of operation of the above-mentioned joining head shall now be explained in more detail with reference to FIG. 1. The two plates 14 and 15, as well as the associated hollow bolts 17 and 18, are separated by known measures and supplied by a prepositioning means to the joining head. The individual parts are already held in the prepositioned position (see left position in FIG. 1). This means that the openings 16 and the hollow bolts 17 and 18 are already arranged to be substantially coaxial to one another, and the plate 15 is arranged below the hollow bolts 17 and 18 and the plate 14 above said bolts. Since a positioning operation is subsequently carried out with the positioning mandrels 1 and 2 and 3 and 4, respectively, the prepositioning operation can be carried out within a relatively wide range of tolerances. The only important feature is that all of the four components are simultaneously supplied to the joining head in this arrangement.

Due to a mechanism, which will have to be described in more detail in the following, the positioning mandrels 1 and 3 and 2 and 4 move towards one another in a uniform and constant way along axes A and B, respectively. During this movement each of the positioning mandrels 1 to 4 move into the openings 16 of the plates 14 and 15 until the cylindrical attachments 9 engage in centering fashion into the bore 17' and 18', respectively, of the hollow bolts 17 and 18 and align the same in coaxial fashion relative to the positioning mandrel 1 and 2 and 3 and 4, respectively. The abutment surface 10 of the positioning mandrels 1 and 2 comes into contact with the faces 21, and the outer surface 10 of the positioning mandrels 3 and 4 with the faces 22 of the hollow bolts 17 and 18. At the same time, the plates 14 and 15 are aligned on the outer circumference of the positioning mandrels 1 to 4 in such a manner that openings 16 occupy an exact coaxial position relative to axes A and B. The positioning mandrels 1 and 3 and 2 and 4, respectively, are moved towards one another not only in a uniform and constant way, but now exert the same forces (symmetrical force application) on the faces 21 and 22, respectively. Independently of the length of the respective hollow bolt 17 and 18, said bolt is centered in symmetry with the main chain axis $K_A$ This means that in the case of both hollow bolts 17 and 18 the faces 21 and 22 are each located at the same distance from the main chain axis $K_A$. This process is illustrated in the central position of FIG. 1 As can clearly be seen, the positioning mandrels 1, 2, 3 and 4 are moved out of the press blocks 7 and 8.

Finally, a symmetrical joining force is applied by way of a uniform and constant movement of the press blocks 7 and 8 towards each other. The press blocks 7 and 8 are here sliding along the outer surfaces of the positioning mandrels 1 to 4 and press with their press block surface 12 against the outsides 19 and 20 of plates 14 and 15. The plates 14 and 15 are thereby pressed onto the outer surface of the hollow bolts 17 and 18 by a predetermined amount. A stop, not shown, ensures that the movement of the press blocks 7 and 8 towards each other is stopped at a specific place, so that the distance of the outer surfaces 19 and 20 of the plates 14 and 15 is exactly defined. The plates 14 and 15 are also arranged in symmetry with the main chain axis $K_A$ due to the symmetrical application of the joining force. During this joining lift of the press blocks 7 and 9 the hollow bolts 17 and 18 are firmly held by the positioning mandrels 1 to 4 in their centered position. Tests have shown that the pressing of the plates 14 and 15 in one lift has an advantageous effect on the press fit. Each further displacement of a component which is only pressed on in part will entail losses in the pressing force.

As can be seen in FIG. 1, one complete joining operation, which in the prior art has required several joining steps, can be carried out by means of a single joining head for achieving a satisfactory quality. Since the chain link is finished in one joining step, the number of pieces to be produced can be increased in comparison with the prior art although the joining speed in the one joining step is much lower. A low joining speed (e.g. 250 sleeves per minute) is also achieved by way of the small displacement paths of the positioning mandrels 1 to 4 and of press blocks 7,8, which in turn has a positive effect on the press fit because, in contrast to the prior art, the plates are not subjected to an impact.

Figure 2:
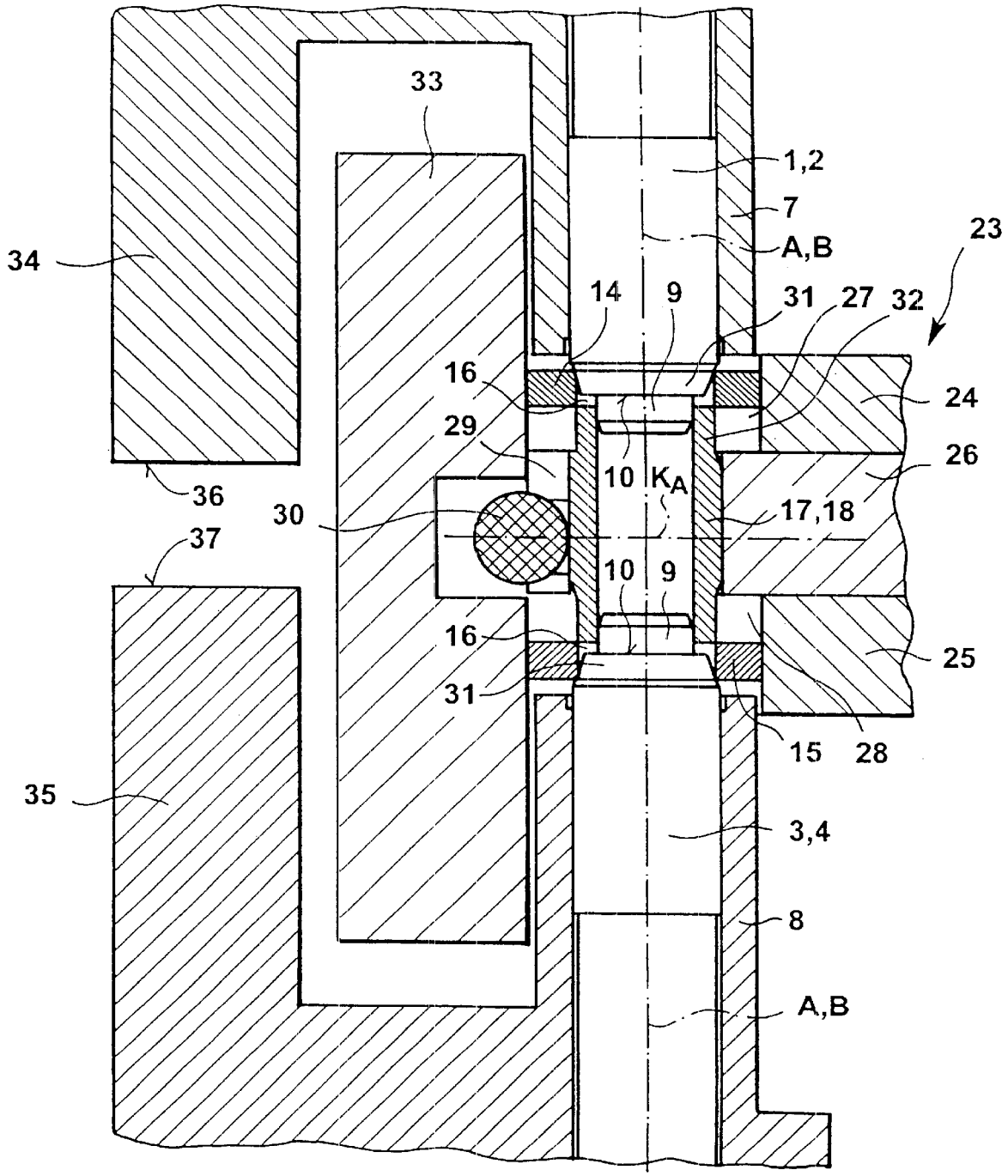
FIG. 2 is a detailed drawing showing the second joining step in an enlarged full section.

A cross section through a joining head is now shown in FIG. 2 in more detail.

Whenever basically identical components are concerned, these are provided with the same reference numerals. As for their detailed description, reference is made to the above description. Only different or additional features shall mainly be explained in the following.

The prepositioned inner chain link 13 is supplied by means of a rotary table 23 which essentially consists of an upper plate 24, a lower plate 25 and an intermediate plate 26. The upper plate 24 comprises recesses 27 for receiving the upper plates 14 and the lower plate 25 comprises recesses 28 for receiving the lower plates 15. The recesses 27 and 28 are adapted to the outer contour of the plates 14 and 15 in such a manner that these can substantially be received in an exact position. The intermediate plate 26 has also formed thereinto outwardly open recesses 29 into which the hollow bolts 17 or 18 can substantially be inserted in accurately fitting fashion. The base of the recesses 29 is rounded and has a radius substantially corresponding to the outer radius of the hollow bolts 17 and 18, and the hollow bolts 17 and 18 are held in their position via an at least partly surrounding round belt 30 (similar to a large O-ring). Two neighboring recesses 29 are respectively molded in in such a manner that the plates 14 and 15 and hollow bolts 17 and 18 are prepositioned in accordance with the distance of the axes A and B. The individual members of the chain link 13 are inserted by corresponding slides into the rotary table 23. The finished chain link is released by moving the round belt 30 away from the intermediate plate 26 into a discharge portion, so that the belt no longer exerts a holding force.

A main difference of the joining head consists in that each of the positioning mandrels 1 and 2 and 3 and 4, respectively, additionally comprises a frustoconical centering portion 31 next to the cylindrical attachment 9. Said frustoconical centering portion 31 ensures in any case that the plates 14 and 15 are aligned relative to axes A and B independently of tolerance variations of the openings 16 in plates 14 and 15. A further conical section may be adjacent thereto. The length of the centering section 31 and the position of the abutment surface 10 are chosen with respect to one another such that upon movement of the positioning mandrels 1 and 3 and 2 and 4, respectively, towards one another a small joining lift is already carried out by which the plates 14 and 15 are already placed on or attached to the outer surface of the hollow bolts. In the instant case this amounts to about one fourth to one third of the overall thickness of plates 14 and 15. This attachment lift is terminated by the abutment of the abutment surface 10 on the faces 21 and 22 of the hollow bolts 17 and 18. However, it is also possible that the positioning mandrels 1 to 4 just serve to guide plate 14 and 15 in such an attaching operation and that the force proper is applied by the simultaneous and parallel downward movement of the press blocks 7 and 8. To this end the centering portion 31 and the press block surface 12 must be brought into contact with the outer surface 19 and 20 of the plates 14 and 15 substantially at the same time. Subsequently, the positioning mandrels 1 to 4 are moved downwards simultaneously and uniformly together with the press blocks 7 and 8 until the positioning mandrels 1 to 4 abut on the faces 21 and 22. Subsequently, just the press blocks 7 and 8 move further towards each other and terminate the joining lift.

However, it is also possible that the positioning mandrels 1 to 4 remain in the position shown in FIG. 2, and that subsequently the press blocks 7 and 9 are moved downwards until contact of the press block surface 12 with the outsides 19 and 20, and positioning mandrels 1 to 4 and press blocks 7 and 8 are then jointly pushed forwards in the above-described way.

The positioning mandrels 1 to 4 will remain in their position as soon as the abutment surfaces 10 press against the faces 21 and 22 with a sufficient force. The hollow bolts 17 and 18 are thereby centered because the forces are the same.

As can additionally be seen in FIG. 2, the hollow bolts 17 and 19 may each be provided with a reduced diameter portion 32 on their end portions. The conditions prevailing in the press fit, in which the plates 14 and 15 are pressed onto the hollow bolts 17 and 18 by press blocks 7 and 8, are thereby improved. A guide rail 33 is provided for preventing the plates 14 and 15 from escaping outwards during supply. An extension 34 is arranged on press block 7 and an extension 35 on press block 8. The extensions 34 and 35 comprise abutment surfaces 36 and 37 assigned to one another, which upon lift of the press block 7 and 8 are arrested and stop their movement and are in contact with one another. Thus the abutment surfaces 36 and 37 define the lowermost lifting position of the press blocks 7 and 8, so that the distance of the plates 14 and 15 from one another is maintained. The extensions 34 and 35 may also be adjustable. The press blocks 7 and 8 are also acted upon with a uniform constant force, so that the plates 14 and 15 are aligned in symmetry with the main chain axis $K_A$. It is also possible that only press block 7 or 8 comprises an extension.

Figure 3:
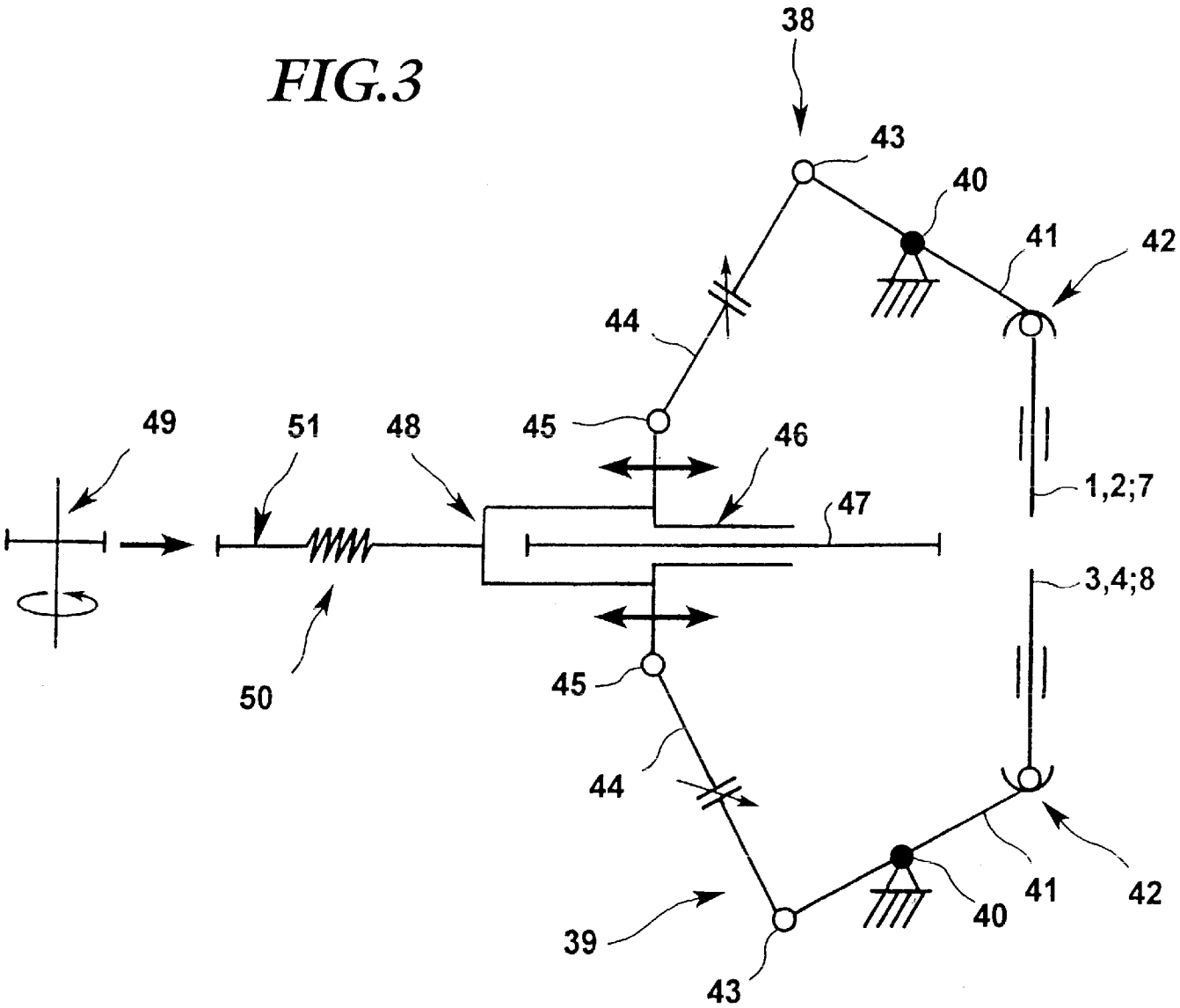
FIG. 3 is a schematic diagram showing a lifting mechanism for actuating the positioning mandrels or press blocks.

The basic structure of a variant of the lifting mechanism for the positioning mandrels 1 and 3 and 2 and 4, respectively, and the press blocks 7 and 8 shall now be described in the following with reference to FIG. 3.

The lifting mechanism comprises a lever linkage 38 connected to the upper positioning mandrel 1 or 2 or the upper press block 7, as well as a lower lever linkage 39 connected to the positioning mandrel 3 or 4 or the lower press block 8. The lever linkages 38 and 39 comprise a respective pivot lever 41 which is arranged around a swivel joint 40 and which is connected via a compensation joint 42 to the corresponding positioning mandrel 1 to 4 or press block 7 or 8. The compensation joints 42 must here convert the pivotal movement of the pivot lever 41 into a purely linear movement. Transverse forces and transverse motion amounts which are here created must be compensated for. The pivot lever 41 is connected by means of a joint 53 to a push rod 44 of adjustable length at its end facing away from the compensation joints 42. The push rod 44 is respectively connected via a joint 45 to a slide bushing 46 which is arranged in reciprocating fashion on a linear guide 47. The slide bushing is force-coupled via a linkage 48 to a cam 49. This means that e.g. linkage 48 moves along both an outer and inner contour of the cam 49, so that the slide bushing 45 is reciprocated. An overload protection means 50 is interposed so that although the movement portion 51 of the linkage 48 can be further retracted, the slide bushing 46 is not moved further. This is respectively the case when the positioning mandrels 1 and 3 or 2 and 4 are in contact with the hollow bolts 17 and 18. Even if the upper and lower press blocks 7 and 8 with their extensions 34 and 35 stop their movement, the overload protection means 50 is operative. With a spring chosen for the overload protection means 50, the force which is applied by the positioning mandrels 1 to 4 and press blocks 7 and 8 can be adjusted quite accurately. Thanks to the symmetrical configuration of the lifting mechanism, the positioning mandrels 1 to 4 are moved towards one another in a uniform and constant manner and with the same force. The same is true for the upper and lower press blocks 7 and 8.

In the joining head shown in FIG. 1, three of said lifting mechanisms can e.g. operate in parallel with one another. The first lifting mechanism operates the positioning mandrels 1 and 3, the second lifting mechanism the positioning mandrels 2 and 4, and the third lifting mechanism is responsible for press blocks 7 and 8. When a spring compensation is additionally created in the area of the positioning mandrels 1 to 4, all of the four positioning mandrels 1 to 4 can also be driven by a single lifting mechanism. The lifting mechanisms may be arranged to be so close to one another that the cams for the lifting mechanism of the press blocks and the lifting mechanism of the positioning mandrels are drivable by one and the same drive around the same rotational axis.

FIG. 4 illustrates further embodiments of the chain links to be produced. At the right side, top, there is e.g. shown an outer chain link 52 which upon a corresponding modification of the positioning mandrels 1 and 2 and the use of a prism guide can be joined by means of a similar joining head. The hollow bolt 17 of an inner chain link 13 is outlined. This is to demonstrate that during production of an outer chain link 52 the inner chain links 134 are interposed, whereby the whole chain can be produced.

Reference numeral b designates the symmetrical projection of the solid bolts 53 by which said bolts project beyond the plates 54.

The duplex chain which is shown in FIG. 4 at the bottom can also be produced by means of a correspondingly constructed joining head. However, the center member 55 of the outer chain link must be preformed in a separate joining operation. To this end the plate 54 is exactly slid onto the main chain axis $K_A$ by means of a similar joining head. This is accomplished by dispensing with the extensions 34 and 35 of the joining head so that the press blocks 7 and 8 carry out an automatic centering operation in the center. The inner chain links 13 are produced in the above-described manner, and the outer plates 57 are symmetrically pressed thereonto in a subsequent process by means of a joining head. The whole construction of the duplex chain is then supplied to the joining head in a prepositioned state in a corresponding circular table. Especially with solid bolts 53 of such a great length as in the case of the duplex chain, the solid bolt 53 is stabilized by cylinder bore 5 or 6 in press blocks 7 or 8. Reference numeral a shows again the same distance from the outer surface of the central plate 56 relative to the face of the solid bolts 53. These have also the same distance from the main chain axis $K_A$.

What is claimed is:

1. A method of joining a chain link having at least one straight link plate joined with at least one bolt by a pressing and aligning process, comprising:

centrally fixing said at least one bolt by simultaneous active application of force-coupled symmetrical clamping forces to end faces of said bolt in relation to a main chain axis that is predetermined by the force-coupled symmetrical clamping forces, and subsequently pressing said at least one straight link plate onto the centrally fixed at least one bolt by a joining lift relative to said at least one bolt into a position symmetrical to said main chain axis.

2. The method according to claim 1, wherein said at least one straight link plate is pushed during said joining lift by the simultaneous active application of symmetrical joining forces into a position symmetrical to said main chain axis.

3. The method according to claim 1, wherein said at least one straight link plate and said at least one bolt are prepositioned relative to each other, so that an opening in said at least one plate is coaxial to said at least one bolt.

4. The method according to claim 1, wherein during the application of said symmetrical clamping forces, said at least one straight link plate is guided in coaxial fashion relative to said at least one bolt after being pressed in part onto said at least one bolt.

5. The method according to claim 1, wherein said symmetrical clamping forces for the at least one bolt are applied by two positioning mandrels that are movable towards one another in a uniform and constant manner.

6. The method according to claim 5, wherein said joining lift is carried out by at least one of an upper and lower press block arranged around said positioning mandrels to apply the symmetrical joining forces.

7. The method according to claim 1, wherein said joining lift is carried out by one positioning mandrel, and said symmetrical clamping forces for the at least one bolt are applied by two positioning mandrels movable toward one another in a uniform and constant manner.

8. A method of joining a chain link having an intermediate straight link plate joined with at least one bolt by a pressing and aligning process, comprising:

symmetrically fixing said intermediate straight link plate relative to a predetermined main chain axis, subsequently pressing said at least one bolt by a joining lift into said symmetrically fixed intermediate straight link plate; and centering said at least one bolt by simultaneous active application of force-coupled symmetrical clamping forces to end faces of said at least one bolt in relation to said main chain axis that is predetermined by said force-coupled symmetrical clamping forces.

9. The method according to claim 8, wherein said intermediate straight link plate and said at least one bolt are prepositioned relative to each other, so that an opening in said plate is coaxial to said at least one bolt.

10. The method according to claim 8, wherein said symmetrical clamping forces for the at least one bolt are applied by two positioning mandrels that are movable towards one another in a uniform and constant manner.

11. The method according to claim 10, wherein said joining lift is carried out by at least one of an upper and lower press block arranged around said positioning mandrels to apply the symmetrical joining forces.

12. A device for joining a chain link having straight link plates, comprising:

an axially movable upper positioning mandrel and an axially movable lower positioning mandrel for positioning and clamping a bolt of said chain link;

a force-coupled actuating mechanism for simultaneously displacing said positioning mandrels toward one another at a right angle relative to a main chain axis and for applying active symmetrical clamping forces to end faces of said bolt via said force-coupled positioning mandrels to centrally fix said bolt relative to said main chain axis; and an upper press block and a lower press block for pressing the straight link plates onto said bolt fixed in a position symmetrical to said main chain axis.

13. The device according to claim 12,including a lifting mechanism for displacing said upper and lower press blocks, said lifting mechanism being adapted to displace said press blocks in symmetry with and at a right angle relative to said main chain axis, and to simultaneously apply active symmetrical joining forces relative to said main axis for performing the joining lift, so that said at least one link plate is pushed in symmetry onto said bolt.

14. The device according to claim 13, wherein said lifting mechanism for said two positioning mandrels comprises a joint drive with forced guidance for moving said two positioning mandrels towards each other in coaxial and symmetrical fashion.

15. The device according to claim 14, wherein said joint drive comprises a slide bushing, a cam for controlling a linear movement of said slide bushing and a symmetrical lever linkage coupled to said slide bushing for moving said positioning mandrels or said press blocks symmetrically.

16. The device according to claim 15, wherein at least one lever section of said lever linkage is adjustable in its length.

17. The device according to claim 16, including an overload protection means of a compressible length between said slide bushing and said cam or in said lever linkage.

18. The device according to claim 13, wherein said lifting mechanism for said upper and lower press blocks comprises a joint drive with forced guidance for moving said two press blocks towards each other in coaxial and symmetrical fashion.

19. The device according to claim 18, wherein said joint drive comprises a slide bushing, a cam for controlling a linear movement of said slide bushing and a symmetrical lever linkage coupled to said slide bushing for moving said positioning mandrels or said press blocks symmetrically.

20. The device according to claim 19, wherein at least one lever section of said lever linkage is adjustable in its length.

21. The device according to claim 20, including an overload protection means of a compressible length between said slide bushing and said cam or in said lever linkage.

22. The device according to claim 12, wherein said positioning mandrels are guided in coaxial bores in said press blocks and are movable relative thereto.

23. The device according to claim 12, for joining an inner chain link, wherein said positioning mandrels comprise a cylindrical attachment movable in accurately fitting fashion into a bore of a hollow bolt of an inner chain link and defining an annular abutment step relative to an adjoining portion of said positioning mandrel to be brought into contact with an end face of said hollow bolt.

24. The device according to claim 12, wherein each of said positioning mandrels comprises a centering portion movable into an opening of said plate to align said plate in coaxial fashion relative to said hollow bolt.

25. The device according to claim 24, wherein said centering portion has a frustoconical shape.

26. The device according to claim 24, wherein said centering portion and an annular abutment step enable a small joining lift to be carried out by said positioning mandrels for attaching said plate to the outer surface of said hollow bolt before said abutment step rests on the end face of said hollow bolt.

27. The device according to claim 22, wherein each of said press blocks comprise a press block surface surrounding the associated positioning mandrels, arranged substantially in planar and vertical fashion relative to the mandrel axes, and adapted to be displaced relative to said positioning mandrels to press said plate onto the outer surface of said hollow bolt.

28. The device according to claim 27, wherein at least one of said upper and lower press blocks comprises an extension adapted to define an exact joining distance of the press block surfaces relative to one another at the end of said joining lift.

29. The device according to claim 27, wherein two upper positioning mandrels and two lower positioning mandrels are respectively arranged for forming a joining head in a jointly assigned upper and lower press block.

30. The device according to claim 12, including a supply means for prepositioning all elements of a chain link and supplying the same in pre-aligned fashion to a joining head.

31. A device for joining a chain link having an intermediate link plate, comprising:

an axially movable upper positioning mandrel and an axially movable lower positioning mandrel for positioning and clamping a bolt therebetween, an upper press block and a lower press block for locking the intermediate link plate in a position symmetrical to a main chain axis, a force-coupled actuating mechanism for simultaneously displacing said positioning mandrels toward one another at a right angle relative to said main chain axis to press said bolt into said intermediate link plate locked by said upper and lower press blocks, and for applying active symmetrical clamping forces to end faces of said bolt via said force-coupled positioning mandrels at least at the end of a joining lift to symmetrically position said bolt relative to said main chain axis.

32. The device according to claim 31, wherein said press blocks include a movable clamping jaw and a stationary clamping jaw to clamp said intermediate link plate in a position substantially symmetrical to said main chain axis, and said at least one positioning mandrel carries out said joining lift.

33. The device according to claim 31, including a supply means for prepositioning all elements of a chain link and supplying the same in pre-aligned fashion to a joining head.

* * * * *